United States Patent [19]

Tellan et al.

[11] Patent Number: 4,649,322

[45] Date of Patent: Mar. 10, 1987

[54] ENERGIZING ARRANGEMENT FOR CONTROLLING THE LUMINOUS INTENSITY OF AT LEAST ONE DISCHARGE LAMP AND USE OF SUCH ARRANGEMENT

[75] Inventors: Alberto Tellan; Pierre Desarzens; Philippe Deglon, all of Bienne, Switzerland

[73] Assignee: Omega Electronics S.A., Switzerland

[21] Appl. No.: 693,923

[22] Filed: Jan. 23, 1985

[30] Foreign Application Priority Data

Feb. 3, 1984 [FR] France ..... 8401800

[51] Int. Cl.[4] ..... G05F 1/00; H05B 37/02; H05B 39/04; H05B 41/00

[52] U.S. Cl. ..... 315/306; 315/228; 315/314; 315/160; 315/161

[58] Field of Search ..... 315/160, 161, 163, 306, 315/312, DIG. 7, 244, 228, 314, 322, 162, DIG. 4

[56] References Cited

U.S. PATENT DOCUMENTS 3,638,070 1/1972 Powell ..... 315/163
4,209,730 6/1980 Pasik ..... 315/244

FOREIGN PATENT DOCUMENTS 1293890 10/1972 United Kingdom ..... 315/160

*Primary Examiner*—Saxfield Chatmon
*Attorney, Agent, or Firm*—Griffin, Branigan & Butler

[57] ABSTRACT

The arrangement of the invention enables control of a light emitting element comprising at least one discharge tube. Firing of the tube is effected by a generator which provides voltage pulses at predetermined periodic intervals ($T_r$). The luminous intensity of the tube is controlled by a D.C. source which enables application of a discharge maintenance current to the tube, the duration of application ($T_c$) of which depends on an instruction signal. A circuit is provided to assure synchronism between the application of the voltage pulse and the maintenance current. The arrangement may be applied in matrix displays.

17 Claims, 7 Drawing Figures

ENERGIZING ARRANGEMENT FOR CONTROLLING THE LUMINOUS INTENSITY OF AT LEAST ONE DISCHARGE LAMP AND USE OF SUCH ARRANGEMENT

This invention concerns an energizing arrangement for controlling, in response to an instruction signal, the luminous intensity of at least one light emitting element comprising at least one discharge lamp and the utilization of such arrangement.

BACKGROUND OF THE INVENTION

Several systems have already been proposed in order to regulate the luminosity of a discharge lamp as for example a fluorescent tube by acting for example on a manual control which in turn controls the conduction of a thyristor during a predetermined time lapse. If the luminous intensity of the discharge lamp must be automatically controlled, for example in order to form an animated image by a multiplicity of lamps from the input of a video signal, one might call on the technique which consists of energizing each lamp by a high frequency generator such as is described in the published European patent application EPO No. 109 671 (U.S. Pat. No. 4,559,480). In this technique the current flowing through the lamp is constituted by the juxtaposition of reference periods, each comprising a plurality of cycles. The intensity of the light emitted is varied by means of an element located in series in the energizing system of the lamp which enables controlling its "on" time by the inhibition of a variable number of cycles contained in each reference period.

The system the operation of which has just been outlined has the advantage of presenting an almost instantaneous turn-on of the lamp and good light efficiency. It however has the disadvantage of necessitating for each lamp a current stabilizing element (ballast) at the same time as requiring a chopped high voltage on the order of 400 volts permanently applied to the terminals of the lamp provided with its ballast during periods when it is to be excited. Such a system presents the difficulty of regulating the discharge current in the lamp.

The same system presents furthermore the disadvantage of requiring the employment of fluorescent tubes each provided with two pre-heating filaments. As a result thereof, there is required the use of an isolating transformer for each of the tubes, thereby leading to complications and greater difficulties for the realization of the overall system.

Various documents which came to light during preliminary research will now be given a short analysis.

U.S. Pat. No. 3,590,316 describes an apparatus serving as ballast for a plurality of discharge lamps. It concerns however a well-known type of turn-on system where the firing and maintenance of the arc are effected by means of a single inductance coil. Contrary to this and as will appear hereinafter, the energizing system according to this invention requires two distinct energizing sources, one serving to fire the arc and the other for its maintenance, this for the purpose of controlling the luminosity of the lamp over a wide range. The cited patent does not separate the creation of the arc and thereafter maintenance of such arc by two different sources, does not permit extended regulation and furthermore does not permit the utilization of the system to energize a tube forming part of a point of a moving image.

U.S. Pat. No. 4,132,925 describes a system comprising a starting circuit and a DC ballast in order to energize a discharge lamp. In this system, as soon as the discharge has begun, the starting circuit becomes inactive and it is the amplitude of the DC current which controls the luminosity of the lamp. One is thus concerned with the regulation of the luminous intensity by variation of the current amplitude and not by variation of the duration of a constant current as is the case in the present invention. In this latter, one is concerned principally with the use of the tube as a matrix component of a video image and for that it is necessary to refresh the luminous points comprising such image at predetermined periods, this being non-realizable in the arrangement of the cited patent.

U.S. Pat. No. 4,219,760 describes a manual system of regulation of the luminous intensity of a discharge lamp. It will be noted however that the energization, moreover summarily described, does not consist of a continuous energization, but a pulsed energization, which is specifically avoided in the present invention.

Finally, French patent 2,397,768 (corresponding to U.S. Pat. No. 4,158,793) likewise fails to show periodic firing or maintenance pulses as has been mentioned hereinabove. Furthermore, one will not find a continuous current source but rather a voltage source. Finally, no method is shown for independently controlling the luminous intensity of each of the three tubes represented which are all controlled at the same time by means of a single control source.

BRIEF SUMMARY OF THE INVENTION

In order to overcome the cited problems of the prior art, the present invention proposes an energizing arrangement for controlling, in response to at least one instruction signal, the luminous intensity of at least one light emitting element having at least one discharge lamp, said arrangement comprising a generator providing voltage pulses at predetermined periodic intervals in order to start the discharge in the lamp and a direct current source of essentially constant amplitude adapted to provide the lamp with a discharge maintenance current in synchronism with each voltage pulse, the duration of said maintenance current being determined by said instruction signal.

DESCRIPTION OF THE PREFERRED EMBODIMENT

A discharge lamp comprises particularly two electrodes to which are applied the control voltages. If the lamp is of the hot cathode type which is the case for an illumination tube of the fluorescent type, there are two cathodes. comprised of filaments covered with a layer of oxide favouring the emission of electrons and enabling the firing of an arc between the electrodes if at the same time one subjects them to a high voltage pulse. In lighting techniques using standard alternating line current, this high voltage is obtained by opening a switch (starter) arranged at the terminals of the lamp and comprising a self-inductance (ballast) mounted in series in the energizing circuit. Once the arc has been started, energization of the filaments is cut off and the exciting current is maintained in the lamp at reasonable values by employing the starter as a current limiting means. To this illuminating arrangement one may attach known control means in order to regulate the luminous intensity emitted by the tube, e.g. a thyristor for which the time of conduction may be varied.

The arrangement which has just been described is not utilizable to energize one or several discharge lamps where one wishes to obtain initially an instantaneous lighting up followed thereafter by a large range of variation of the luminosity. Effectively, on one hand the employment of the known type of starter causes a delay in the turn on and on the other hand the conduction periods of a thyristor are limited relative to the energizing cycle. Trials have likewise shown that the life of the tube is shortened considerably if it is energized by such an arrangement since the temperature of the electrodes is insufficient at low luminosity.

Figure 1:
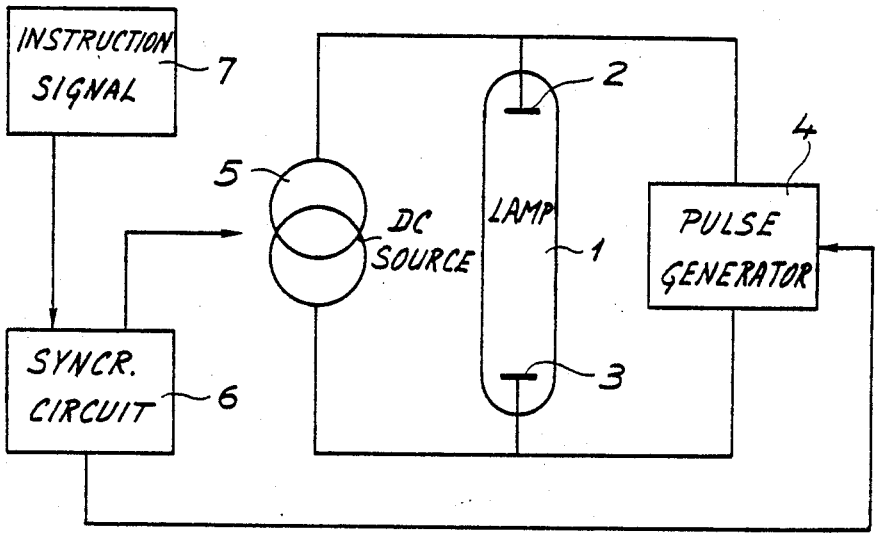
FIG. 1 is a general schematic drawing showing the energizing arrangement of a discharge lamp in accordance with the invention.

FIG. 1 is a general schematic that shows the energizing arrangement, according to the invention, of a discharge lamp for which it is desired to regulate the luminous intensity. The discharge lamp 1 is provided with two electrodes 2 and 3. A generator 4 provides voltage pulses at predetermined periodic intervals to the electrodes capable of starting the discharge in the lamp. One will likewise find a direct current source 5 connected to the same electrodes. In this system the luminous intensity of the lamp will depend on the duration of the application $T_c$ of the current furnished by source 5 between each voltage pulse furnished by the generator 4. Thus each starting pulse is followed by a period of application $T_c$ of a discharge maintenance current, the two signals being synchronous. In FIG. 1, block 6 symbolizes a synchronization circuit which activates the current source 5 when it has received from generator 4 the information that the voltage pulse has been sent to lamp 1. As has already been said, the luminous intensity emitted by the lamp will depend on the duration of the application of the current from source 5. This duration is controlled by an instruction signal applied by circuit 7 which interrupts the current from source 5 as a function of the desired luminosity.

Figure 2:
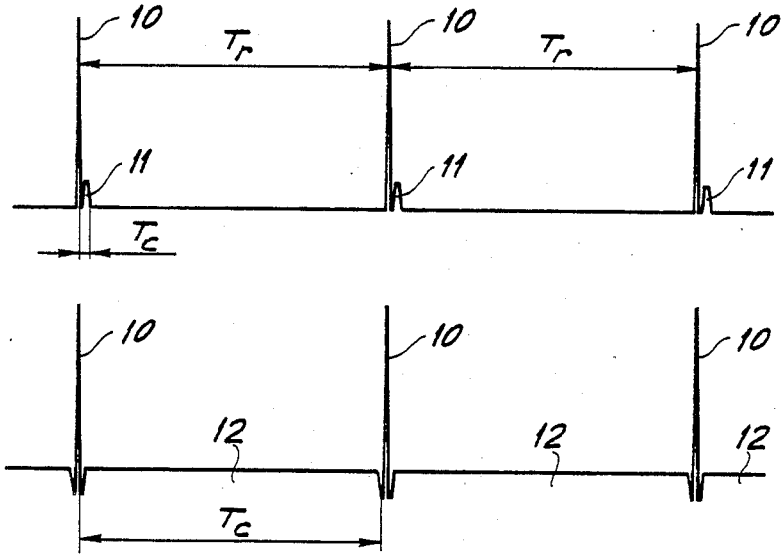
FIG. 2 shows the form of the voltage at the electrodes of the lamp when it is energized by means of the arrangement shown in FIG. 1.

FIG. 2 shows the form of the voltage at electrodes 2 and 3 of lamp 1 in a first case of very low luminosity (FIG. 2*a*) and in a second case of luminosity close to the maximum (FIG. 2*b*). In the first case, pulses 10 coming from generator 4 and which are repeated at periodic intervals $T_r$ are followed by arc maintenance voltage 11 of very short duration $T_c$. In the second case, the same pulses 10 are followed by arc maintenance voltage 12 of which the duration $T_c$ occupies almost all the space available between two pulses. It will be noticed that in this system one is concerned with a modulation of the duration when the amplitude of the direct current furnished by source 5 remains basically constant. It will be noted that the case of lowest intensity luminosity is that where the duration of application $T_c$ of voltage 11 is zero (FIG. 2 top plot) and that the case of maximum luminosity is that when $T_c = T_r$ (FIG. 2 bottom plot).

It has been seen that the luminous intensity of the lamp emission depends on the period during which the maintenance current is applied between two starting pulses and that this period is controlled by an instruction signal. Such instruction signal may be provided by simple manual regulation, e.g. a potentiometer. It may likewise be provided by a signal of low frequency, e.g. musical. The present invention may however find its major application in the reproduction and the display of images or texts, either fixed or animated, black and white or in colour. In such case, instruction signals may be obtained from a video source.

FIG. 1 shows a light emitting element comprising a single lamp, preferably a fluorescent tube producing white light. This element and the control arrangement which is associated therewith may constitute one luminous point (pixel) of a portion of an image comprising a group of such points. In turn, a multiplicity of groups of points may form a large dimension image as may be found for instance in matricial displays intended for instance for stadiums where a large number of spectators are assembled. For this application it will be understood that to each light emitting element must correspond a source of maintenance current 5 arranged in a manner to be capable of independently varying the luminous intensity produced by the lamp to arrive at the multiple grades of light which may comprise an image. It is then possible to display texts such as sporting results, advertising matter, animated events or retakes of the events by means of cameras, recorded discs or magnetic tapes which bear instruction signals controlling in turn the current maintenance source.

Figure 3:
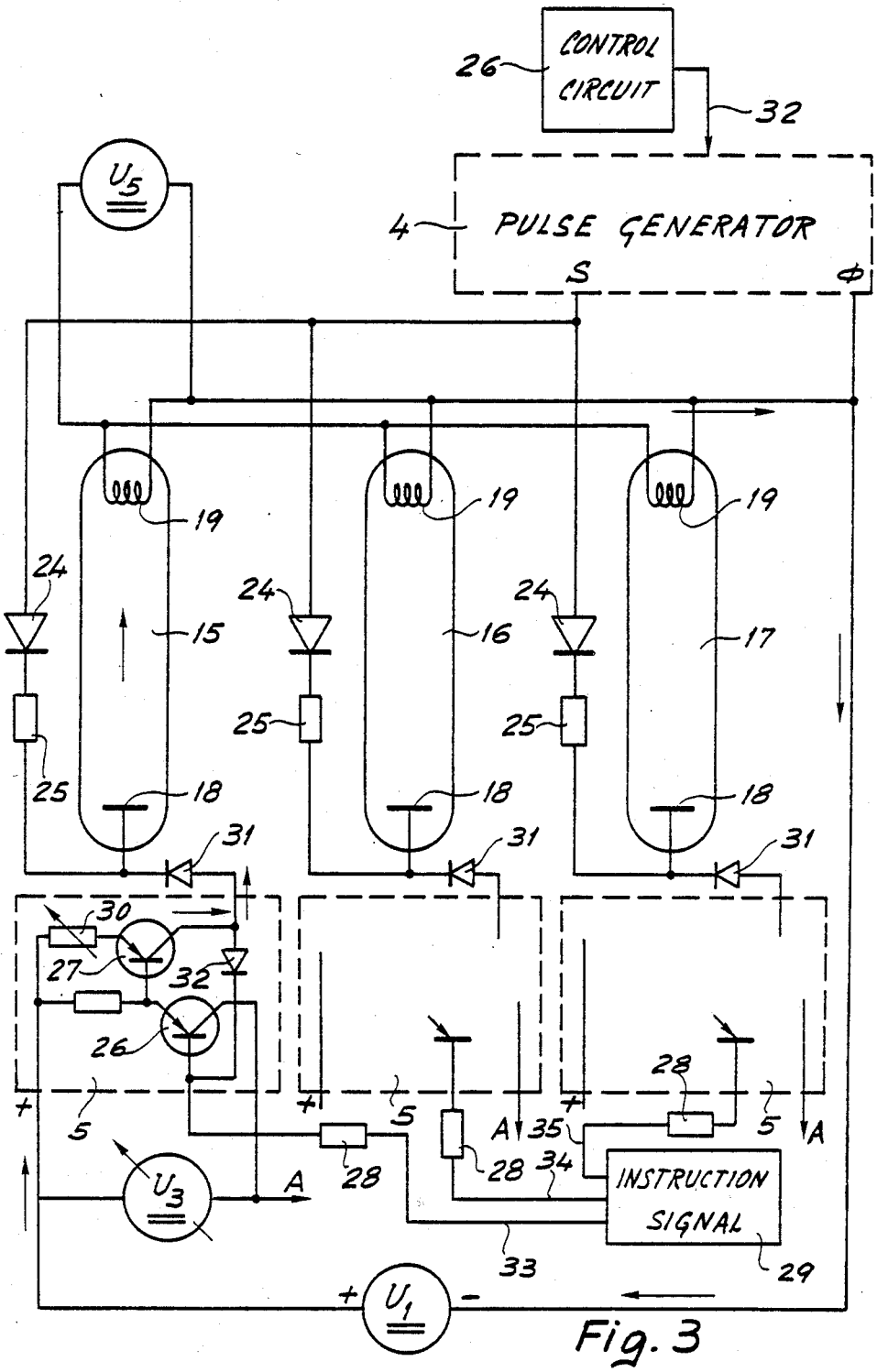
FIG. 3 is a detailed schematic drawing of the energizing source of a light emitting element comprising three fluorescent tubes.

FIG. 3 shows in detail an example of realization of the control arrangement which has been summarily sketched on FIG. 1. The element shown in FIG. 3 comprises however three discharge lamps 15, 16 and 17 which are tubes for which the interior of the glass walls have been coated with different fluorescent substances (phosphors) in order to obtain three primary colours, e.g. red, green and blue.

Each tube is provided with a cold electrode 18 and a hot electrode 19 in the form of a filament. Each filament is energized permanently by a common energizing source $U_5$. The heater power for each tube is on the order of 1 watt. The filament is covered by an emitting oxide and acts as a cathode. One might also envisage indirect heating of a cathode insulated from the heating filament in the same manner as for electronic tubes. The advantage one has with the arrangement according to the invention requiring only one heated filament per tube will be readily appreciated. It will be understood effectively that if electrode 18 were to be heated. It would be necessary to provide as many heater current sources as there are tubes since in order to operate according to the principle proposed here, electrodes 18 and 19 must be galvanically separated. Whatever may be the case, experience has shown that a single active filament is sufficient to effect the desired electron emission and to assure starting of the arc at the moment of application of the high voltage at the terminals of the tube. If one has available tubes already provided with two filaments as is usually the case, it will be necessary to heat only one thereof.

On FIG. 3 will be noted generator 4 already outlined on FIG. 1 and adapted to provide to all tubes simultaneously the pulses necessary to effect starting of the discharge. These pulses appear at terminals S. $\phi$ of generator 4.

Figure 4:
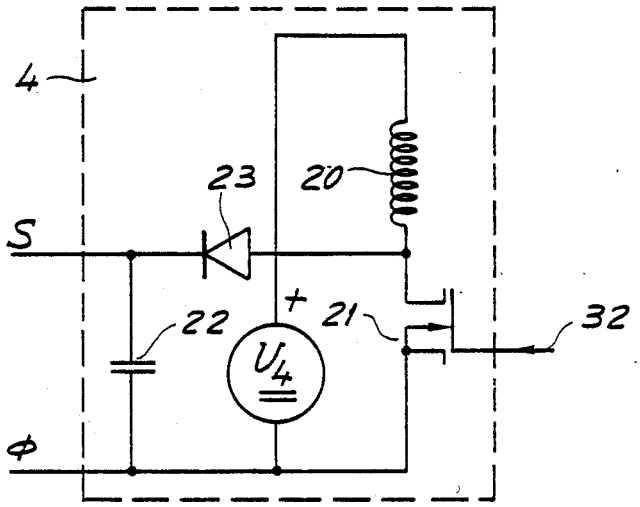
FIGS. 4 and 5 each show a possible schematic for the realization of the high voltage generator 4 which appears in FIG. 3.
Figure 5:
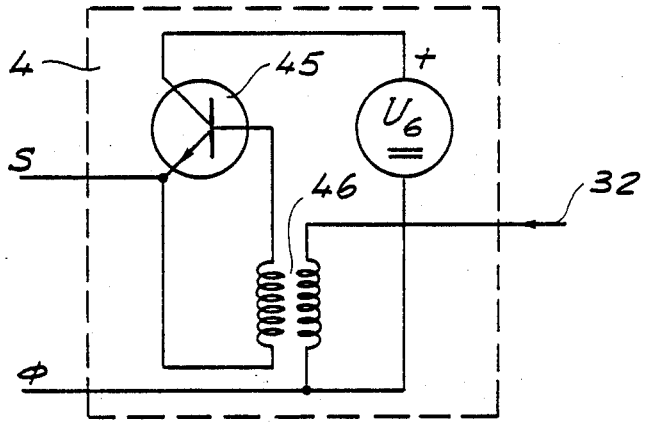

Next we will refer to FIGS. 4 and 5 which illustrate two possible realizations of generator 4.

The generator 4 shown on FIG. 4 consists essentially of a DC voltage source $U_4$, a coil 20, a switch 21 and a capacitor 22. In such a system, the energy stored in coil 20 in the form of current during the closing of switch 21 is yielded up in the form of voltage at the terminals of capacitor 22 when the switch 21 is opened. The amount of accumulated energy is determined by voltage $U_4$, the inductance of coil 20 and the period of accumulation $t_1-t_0$, $t_0$ representing the instant of closing and $t_1$ the instant of opening of switch 21. The stored energy may be expressed by the relationship $$E_{acc} = \frac{1}{2} \cdot \frac{U_4^2(t_1 - t_0)^2}{L} \text{ where } U_4 = \text{constant}$$

By transferring this magnetic energy into a capacitor 22 of capacity C, one may then control the value of the high voltage $U_S$ thereby obtained. If the energy yielded up is expressed by the relationship.

$$E_{rest} = \frac{1}{2} CU_S^2$$

and that the transfer of energy imposes $E_{acc}=E_{rest}$, one will obtain as value of the high voltage $$U_S = \sqrt{\frac{U_4^2 (t_1 - t_0)^2}{LC}}$$

Thus, to take a practical example, with a source $U_4$ of 12 volts, a coil L of 25 mH, a closing period of the switch 21 on the order of 100 $\mu$s and a capacitor C of 120 pF, the high voltage present at the terminals S, $\phi$ will be on the order of 700 V.

In order to avoid oscillation of the LC circuit formed by the elements 20 and 22 and thereby the discharge of capacitor 22 into the source $U_4$, a diode 23 is placed in the circuit.

Switch 21 may comprise a transistor of the MOSFET type dimensioned in order to withstand the high voltages which may occur at its terminals. One may use for instance an element obtainable from the Siemens company and which bears the identification symbol BUZ 50 A. The control of this transistor is assured via line 32 by a control circuit 26 appearing on FIG. 3 and which provides at predetermined periodic intervals pulses of width $t_1-t_0$. An example of the realization of this block is given hereinafter.

Generator 4 shown on FIG. 5 is a preferred solution when one is concerned with starting a large number of tubes, e.g. more than thirty. It comprises a DC voltage source $U_6$ on the order of 900 V and a switch 45. The control of the switch is assured via transformer 46 by line 32. When a control pulse is emitted by control circuit 26 (see FIG. 3), switch 45 is closed and the high voltage $U_6$ is applied to the output terminals S, $\phi$ during a very short time duration (on the order of 5 $\mu$s).

If one refers now to FIG. 3, it will be seen that the high voltage pulses emitted by generator 4 on terminals S and $\phi$ are applied to each of the tubes via a diode 24 and a resistor 25. These resistors 25 have as purpose the limitation of the arc current in the tube at the moment that it is fired. This artifice assures lighting up all lamps by means of a single generator. Without this, from the fact that the lamps present different starting characteristics, only the lamp requiring the lowest voltage pulse would be lighted up. Effectively, the tension present at the terminals of the tube, once the arc has been established, is clearly less than that necessary to start it up. A substantial current, however, would flow if no precautions were taken. This current would prevent, on the one hand, the starting voltage from attaining the value necessary for starting the other tubes and could, on the other hand, bring about destruction of the first tube started.

On FIG. 3 will likewise be found for each of tubes 15, 16 and 17, a DC current source for maintaining the discharge for which the role has been explained in respect of FIG. 1. Here, there are as many sources 5 as tubes in order to permit independent regulation of the light intensity from each of them. The current sources 5 are all energized by a common voltage source $U_1$. A current source 5 comprises essentially a cascade arrangement of two transistors 26 and 27. The base of transistor 26 is energized through a resistor 28 by the instruction signal coming from block 29 of which an example will be described hereinafter. When a signal is present on the base of transistor 26, the current source 5 provides a current in the sense of the arrows on the figure and the luminous intensity of the tubes will depend on the time during which the signal is applied. The current source 5 includes a safety diode 32 which prevents destruction of transistor 26 when the current source provides no current.

It is likewise clear that the possibility has been foreseen to regulate individually the current provided by each source by acting on potentiometer 30 placed in series in the emitter circuit of transistor 27. This enables balancing among the luminous flows emitted by each tube when all receive an instruction signal of the same duration. Likewise, it is possible to regulate the current from all sources by an equal amount at the same time. In order to arrange this, the collector of transistor 26 is energized by a variable voltage source $U_3$ common to all current sources 5. A voltage $U_3$ varying between 3 and 6 volts will generally suffice to satisfy the needs which may arise and which include among others the adaptation of the luminosity emitted by the group of tubes to the ambient light level.

It will further be mentioned that a feed voltage $U_1$ of 60 V DC enables in the arrangement as described the assurance of an arc voltage of about 40 volts in the tube. Finally, as it is necessary to isolate the current sources 5 from the pulse generator 4, the schematic of FIG. 3 shows further incorporation of two diodes 24 and 31. Diode 24 prevents the current source 5 from one tube to energize another tube via the common line of the high voltage generator. Diode 31 prevents the high voltage pulse coming from generator 4 to cross over the current source 5.

The light emitting element the function of which has just been described generally comprises three fluorescent tubes arranged side by side or nested in one another according to the arrangements which have been set forth in European patent application EPO No. 109,671 cited hereinabove. It will be understood that in regulating the time during which current is injected in each of tubes 15, 16 and 17 one may obtain a resulting light the colour of which may be varied over the entire spectrum of visible shades. Additional blending of the three prime colours may be realized by means of a matt surface glass which is placed in front of the element. Such blending may also come about naturally if one observes the element from a certain distance.

The richness of the colours or if one wishes, the number of different colours or tones which may be obtained from such an element will depend on the number of tones presented by each of the tubes forming the element. With the recommended arrangement one may obtain at least $2^5=32$ intensities of light per tube. Finally, if one tube enables 32 intensities of light, three tubes of different colours will enable $2^{15}=32{,}768$ different tones.

In the arrangement as described, the 32 light tones corresponding to the 32 different periods of excitation of the tubes must be obtained in the interval between two successive high voltage pulses. If one takes into account however the sensitivity curve of the eye, it should be noted that the luminance represented by a number of candelas emitted per area unit of lighted surface of the element and which is seen by the eye is not a linear function of the duration of excitation of the tube. Weber recommends for day time lighting the conversion curve $$L = 10\left(\frac{4S-1}{20}\right) \tag{1}$$

while for the nocturnal lighting there is preferred the relation provided by Wyszecky and which is written $$L = \left(\frac{10S+17}{25}\right)^3 \tag{2}$$

where L represents the luminance and S the relative level of excitation of the luminous source. The present arrangement makes use of the laws given hereinabove by determining the relative level of excitation from the period during which the fluorescent tube is energized.

Mention should also be made of the periodicity of the high voltage pulses. In the special case where the arrangement as described is applied in the reproduction of animated images coming from a video signal for instance, it will be understood that a point image (the light emitting element cited in the claims) must be refreshed or, in other terms, must be capable of receiving new information, at least every 1/25 of a second where the line frequency is 50 Hz (1/30 of a second in cases of line frequencies of 60 Hz), this leading to a repetition of the high voltage pulses every 40 ms. However, this periodicity should be chosen to be less than 20 ms in order to avoid image flickering which one reduces by the process of interlacing thereof.

Figure 6:
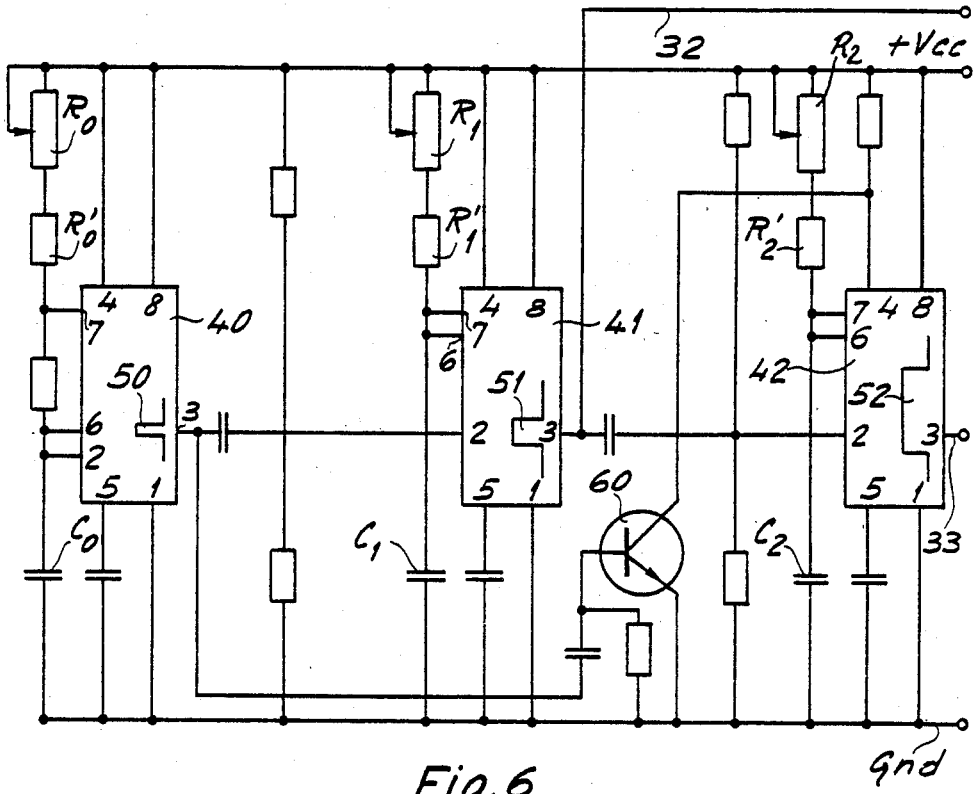
FIG. 6 is a schematic of one possible realization of the blocks 26 and 29 shown in FIG. 3.
Figure 7:
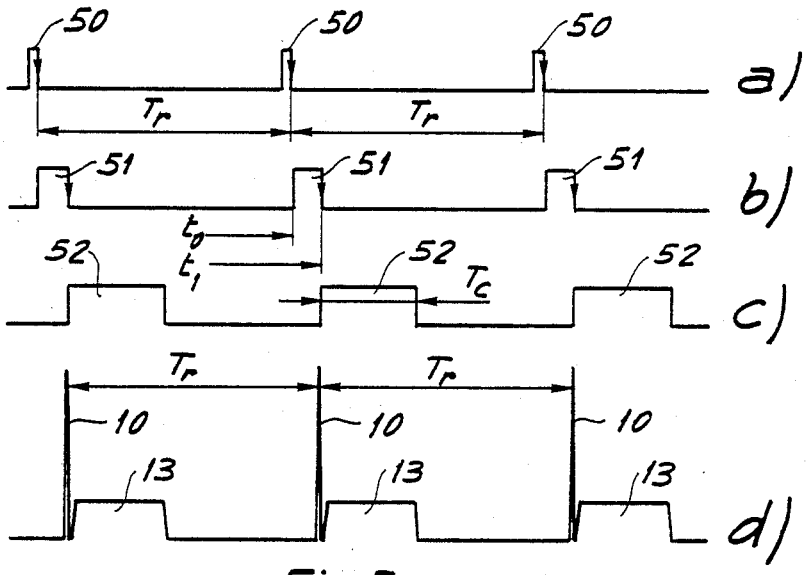
FIG. 7 shows the various signals formed by the circuit of FIG. 6 as well as the form of the voltage at the terminals of the lamp resulting from the combination of said signals.

FIG. 6 shows a possible realization of blocks 26 and 29 shown on FIG. 3. It comprises essentially three circuits 555 well known to the state of the art and referenced 40, 41 and 42. The first circuit 40 is a generator which forms short pulses 50 presented on the output 3 and of which the form is shown on FIG. *7a*. The repetition period $T_r$ of the pulses depends on the values which are given to $R_0+R'_0$ and $C_0$. It may be adjusted by varying $R_0$. Pulses 50 control in turn circuit 41 which is a monostable multi-vibrator which is fired on the falling edge of pulse 50 and prolongs each pulse by a quantity determined by the given values of $R_1+R'_1$ and $C_1$. It may be adjusted by varying $R_1$. The pulse resulting therefrom and which is shown on FIG. *7b* is picked up at the output 3 of circuit 41 and controls via line 32 either switch 21 of generator 4 shown on FIG. 4 or the transformer 46 of generator 4 shown on FIG. 5 according to whether the one or the other of these variants has been chosen. Thus block 26 of FIG. 3 is constituted in this particular example by circuits 40 and 41 of FIG. 6 in order to generate pulse 51 of width $t_1-t_0$. Pulses 51 control in turn circuit 42 which is likewise a monostable multivibrator which is fired on the falling edge of pulse 51 and prolongs each pulse by a quantity determined by the values given to $R_2+R'_2$ and $C_2$. Pulse 52 of duration $T_c$ which results therefrom and which is shown on FIG. *7c* is presented at output 3 of circuit 42 and controls via line 33 the switching of current generator 5 feeding tube 15 as is seen on FIG. 3. Pulse 52 is none other than the instruction signal coming from block 29 of the same FIG. 3, said block 29 being formed in this particular example by circuit 42 of FIG. 6, a circuit which functions thus in synchronism with the starting pulse generator of the tube. It is evident that to provide maintenance current to the three tubes 15, 16 and 17 of the light emitting element shown on FIG. 3, it will be necessary to provide two further circuits 42 identical to that shown on FIG. 6. These two further circuits 42 will then be applied to the two other generators 5 by lines 34 and 35.

It is further noted in FIG. 6 the presence of a circuit comprising transistor 60 having as purpose to reset the monostable multivibrator 42 as soon as a new pulse 50 appears at the output of circuit 40, this in order to avoid overlapping of pulse 50 onto pulse 52 which would not yet be terminated.

Finally, FIG. *7d* shown as supplement the voltage which appears at the electrodes of the tube and which is the result of the combination of what is shown in diagram *7a*, *7b* and *7c*. Thus, the high voltage pulse 10 coincides with the falling edge of pulse 51 and the modulation voltage 13 (or maintenance of the arc) coincides with pulse 52.

The schematic of FIG. 6 enables varying the light intensity by means of a potentiometer regulator $R_2$ which is here the instruction signal seen in the abstract. It is clear that this regulation could be realized in a manner completely different if the instruction signal were to be in the form of information furnished by a television camera for instance. In this case the camera provides at its output an analog signal which will be transformed into a digital signal by means of an A/D converter. One then will find at the output of the converter $2^5=32$ possible values corrected according to formulae (1) and (2) given hereinabove, one of which will correspond to the luminous intensity of the point analyzed at a precise given moment. The digital information is thereafter transmitted to a counter which will restore at its output a signal the duration of which corresponds to the luminous intensity analyzed at this moment. This signal finally will control a maintenance current source as has been described hereinabove.

What we claim is:

1. An energizing arrangement for controlling, in response to at least one instruction signal, the luminous intensity of at least one light emitting element having at least one discharge lamp, said arrangement comprising a voltage pulse generator including at least a direct voltage source and a switch means connected in series with said direct voltage source and activated at predetermined periodic intervals to provide voltage pulses of short duration to said lamp in order to start the discharge in the lamp, an instruction-signal producing means for producing a controllable instruction signal and for allowing the modification of said instruction signal without changing activation of said switch means, and a direct current source of essentially constant amplitude responsive to said instruction signal and adapted to provide the lamp after each voltage pulse with a discharge maintenance current, the duration of said maintenance current after each voltage pulse being determined by said instruction signal, whereby the instruction signal can be modified to vary the duration of the maintenance current after each voltage pulse to thereby vary the luminous intensity of said light emitting element without changing said voltage pulses for starting discharge of said lamp and without otherwise changing the amplitude of said maintenance current.

2. Energizing arrangement as set forth in claim 1 wherein terminals of the lamp are connected to voltage pulse generator terminals via a resistance arranged in series therewith so as to limit the current in the lamp.

3. Energising arrangement as set forth in claim 1 wherein the maintenance current is applied after each voltage pulse over a time period not exceeding the time interval separating the voltage pulses, said period having at least thirty two different values.

4. Energizing arrangement as set forth in claim 1 wherein the interval separating said pulses is less than 20 ms.

5. Energizing arrangement as set forth in claim 1 arranged and adapted to control a group of light emitting elements, each element including a fluorescent discharge tube emitting white light, there being as many maintenance current sources as there are tubes in order to control independently the luminous intensity emitted by each tube.

6. Energizing arrangement as set forth in claim 1 arranged and adapted to control a light emitting element comprising at least three fluorescent discharge tubes each emitting light of a different primary colour, there being as many maintenance current sources as there are tubes in order to control independently the luminous intensity emitted by each tube thereby to obtain a resultant light output the colour of which may be varied over the entire visible spectrum.

7. Energizing arrangement as set forth in claim 1 arranged and adapted to control a group of light emitting elements each element including at least three fluorescent discharge tubes, each emitting light of a different primary colour, there being as many maintenance current sources as there are tubes, in order to control independently the luminous intensity emitted by each tube, thereby to obtain a matrix of points the colour of which may be varied over the entire visible spectrum.

8. Energizing arrangement as set forth in claim 1 wherein there is a plurality of discharge lamps to be controlled in the form of fluorescent tubes each being provided with a single active filament, with all filaments permanently energized from a common source.

9. Energizing arrangement as set forth in claim 8 comprising one voltage pulse generator only common to all tubes.

10. Energizing arrangement as set forth in claim 8 comprising as many maintenance current sources as there are tubes, each such source having means for manually adjusting the amplitude of the current flowing in the tube associated therewith.

11. Energizing arrangement as set forth in claim 10 wherein the maintenance current sources are provided with common means for simultaneously adjusting the current amplitude in all the tubes energized by said sources.

12. Energizing arrangement as set forth in claim 10 wherein the maintenance current sources are energized by a common voltage source.

13. Energizing arrangement as set forth in claim 10 wherein each tube has associated therewith a first diode connected in series between the voltage pulse generator and an electrode of the tube and a second diode connected in series between the associated maintenance current source and said electrode.

14. Energizing arrangement as set forth in claim 11 when employed in a matrix type display either black and while or polychrome.

15. An energizing arrangement as set forth in claim 1 wherein said voltage pulse generator comprises a low direct voltage source, a coil, and said switch means arranged in series, with respective terminals of the lamp being connected in parallel with said switch means so as to subject the lamp to a voltage pulse at each switch opening which is greater than said low direct voltage source.

16. Energizing arrangement as set forth in claim 15 wherein the voltage pulse generator further includes a capacitor arranged at the switch terminals in order to limit the voltage pulse amplitude to a controllable value.

17. An energizing arrangement as claimed in claim 1 wherein said generator comprises a high direct voltage source and said switch means, both of these elements being connected in series with each other and in series with said lamp so as to subject said lamp to a voltage pulse at each switch closing.

* * * * *